United States Patent [19]

Tyree et al.

[11] Patent Number: 4,530,561

[45] Date of Patent: Jul. 23, 1985

[54] EDGE CONNECTOR

[76] Inventors: Christopher W. Tyree; John M. Poland, both of 155 Queen St., Beaconsfield, New South Wales, Australia, 2015

[21] Appl. No.: 394,221

[22] Filed: Jul. 1, 1982

[30] Foreign Application Priority Data

Jul. 8, 1981 [AU] Australia ..... PE9647

[51] Int. Cl.[3] ..... H01R 13/514

[52] U.S. Cl. ..... 339/134; 339/176 MP

[58] Field of Search ..... 339/17 L, 176 MP, 132, 339/276 A, 125 R, 134; 248/222–224

[56] References Cited

U.S. PATENT DOCUMENTS

| | | | |
|---|---|---|---|
| 3,172,718 | 3/1965 | LaLonde | 339/276 A X |
| 3,601,770 | 8/1971 | Bowley | 339/17 L X |
| 3,822,916 | 7/1974 | Haag et al. | 339/176 MP X |
| 3,951,494 | 4/1976 | Romine | 339/17 L |

FOREIGN PATENT DOCUMENTS

| | | | |
|---|---|---|---|
| 2638604 | 2/1978 | Fed. Rep. of Germany | 339/125 R |

*Primary Examiner*—Eugene F. Desmond

*Attorney, Agent, or Firm*—Townsend & Townsend

[57] ABSTRACT

An electrical connector including a body section 1 and feet members 2 mounted at either end of the body section. The body section includes a longitudinal slot and a number of transversely oriented contact recesses 3. Electrical contacts are fitted within the contact recesses in a conventional manner. The feet members include a pair of upper projection 11 and a lower projection 13, the projections having opposed, inwardly directed lips 12, 14. Projections 11, 13 and lips, 12, 14 are sized and positioned so that upper projections 11 extend over the top of body section 1 and lower projection 13 extend under the body section with lips 12, 14 extending into contact recess 3. So that feet members 2 have the same height as body section 1, a pair of channels 15 and a groove 9 are formed within the top and bottom of body section 1 to house projections 11, 13 therein.

8 Claims, 4 Drawing Figures

EDGE CONNECTOR

BACKGROUND OF THE INVENTION

The present invention relates to connectors for printed circuits and the like. In particular, it relates to connectors formed individually by the assembly of blocks of insulating material and contacts into such assemblies which may readily be shortened, either before or after completion of their assembly, to eliminate undesired lengths of connectors and provide a desired number of contacts only.

There is a pseudo standard for the dimensions of these connectors which has been established by common use in addition to the dimensions specified under United States military specification MIL-C-21097. These standard dimensions relate to:

Card insertion depth
Overall height of connector
Card slot width
Distance between mounting centres.

This pseudo standard can be readily assessed by compiling a chart of dimensions from 10 to 20 of the world's leading connector manufacturers. All these dimensions however relate to connector bodies moulded in one piece.

This type of prior art connector having therefore been provided in sizes to include fixed numbers of contacts depending on the contact pitch. E.g., for a pitch of 3.96 mm. standard connector lengths are 6, 10, 15, 18, 22, 28, 36 and 43. When there has been a need for more contacts than are in a standard unit but fewer in the next larger size, the next larger size has been used with a corresponding waste of contacts and the cluttering of space with unused parts.

Prior art connectors have been available only in dimensions which do not allow the connector to be fully compatible with the standard dimensions of the one piece moulding.

Prior art connectors have also required very close tolerances when being cut to length.

Prior art connectors have severe limitation in their variety of mounting provisions.

Attempts have been made to overcome these problems, however these attempts have not been completely successful.

Australian Patent No. 503,549 describes an electrical connector having five parts; the metal contacts, the body, a slide element made from insulating material which holds the contact elements in the body and two end feet which have teeth which mate into the contact cavities and lock the slide securely into the body of the connector.

However it has been found in practice that feet having no top clamping means are prone to work themselves loose or snap under certain conditions. If the end foot works itself loose from the body, not only does it run the risk of falling off but the tabs on the printed circuit board will certainly not line up with the contacts on the connector. Further, although connectors made under the above mentioned Australian Patent are able to meet the pseudo standard for card slot width and mounting hole dimensions, one of either connector height or card slot depth have to be sacrificed making the connector too high for many applications. Additionally cutting tolerances on this connector are exceedingly critical and the assembly time is far in excess and requires more equipment than the subject of this specification.

Another prior art connector is shown in German Patent No. 1,936,019. However, this suffers from the same disadvantage as the connector of the beforementioned Australian Patent, in that the tolerances of the components must be very exact to ensure adequate connection and as a result is prone to the end foot slipping loose. Another disadvantage is that the connector of the German Patent would not satisfy the height limitations required for standard connectors.

A further prior art connector is described in U.S. Pat. No. 3,131,016 in the name of A. B. Clewes. In the Clewes connector the two end contact position are lost as a projection from the foot slides into the end contact position to completely block them. Thus this solution has not been fully satisfactory.

SUMMARY OF THE INVENTION

Accordingly it is an object of the present invention to provide connectors which may be shortened to provide only a desired number of contacts with feet which firmly engage onto the connector ameliorating problems associated with the prior art.

The present invention therefore provides an electrical connector comprising:

a supportive body;

a row of contact cavities arranged in said supportive body to receive contact elements;

retaining means associated with said cavities for retaining contact elements in said row; and feet means having top and bottom projections with re-entrant lips so as to lock the feet means securely onto the supportive body without interferring with the contact elements in the said rows.

BRIEF DESCRIPTION OF THE DRAWINGS

The invention will now be described with reference to the accompanying drawings in which.

DETAILED DESCRIPTION OF THE PREFERRED EMBODIMENT

As can be seen from the figures the preferred embodiment comprises four parts:

a body section 1;

two feet members 2; and, contact member (not shown).

Figure 1:
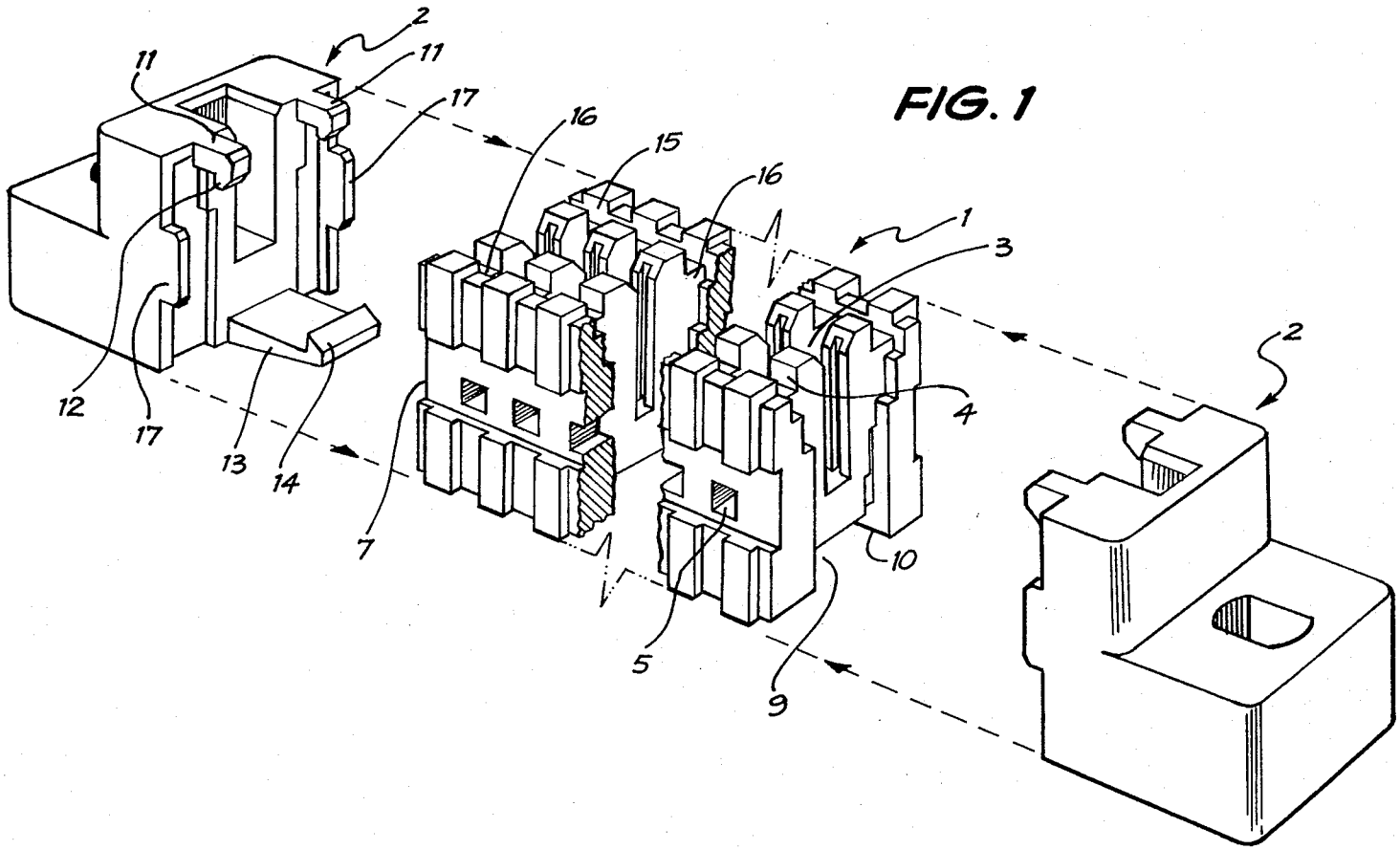
FIG. 1, is an exploded perspective view of a connector according to a preferred embodiment of the present invention.
Figure 2:
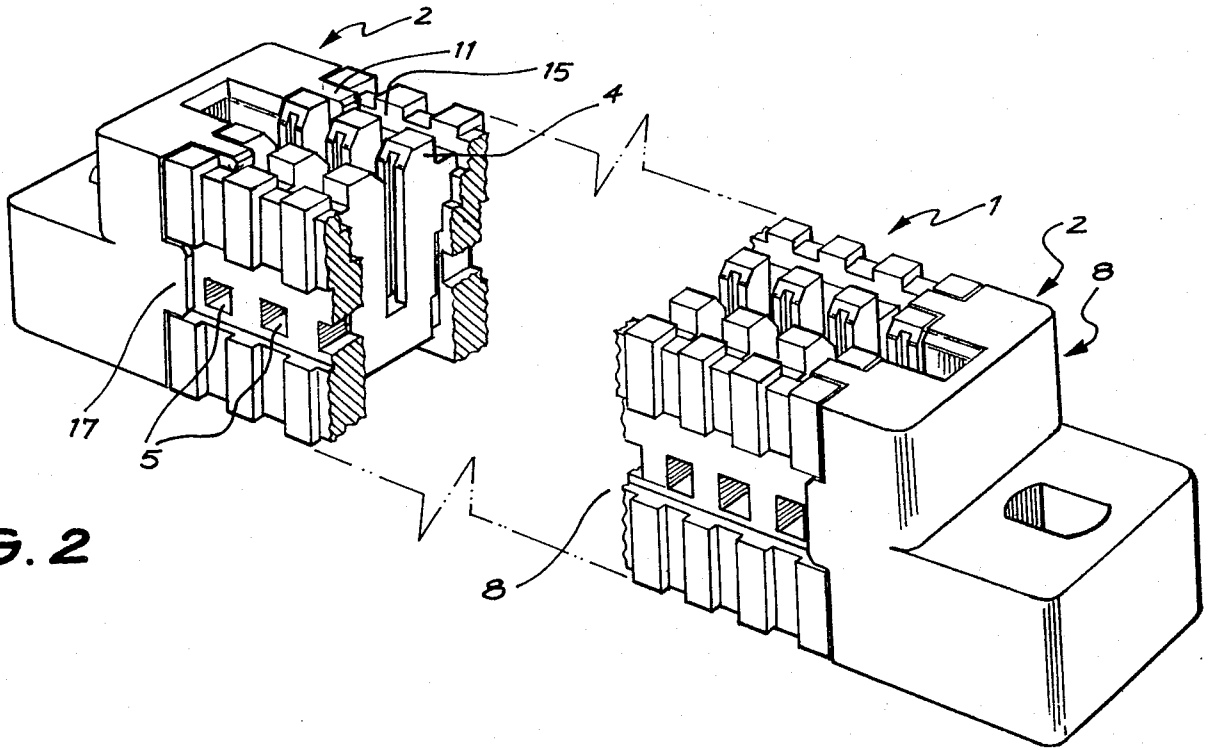
FIG. 2, is a perspective view of the assembled connector of the FIG. 1.
Figure 3:
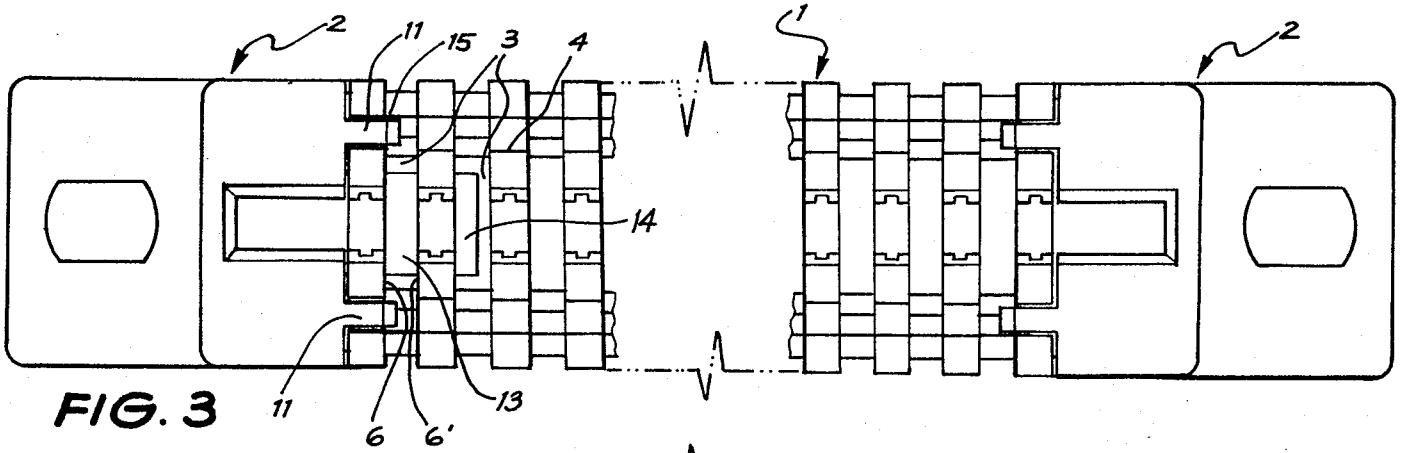
FIGS. 3 and 4, are respectively plan and bottom plan views of the connector of FIG. 2.

The body section 1 as can be seen in FIGS. 1 to 3 comprises a series of contact recesses 3. The contacts can be affixed by any suitable means into these recesses 3, such as by clipping over the shoulders 4 or clipping into the openings 5 which extend into the recesses 3 or by a forced fit between adajacent walls 6 and 6' of the recesses 3.

The body section 1 also has a groove 7 running along the two lateral sides 8. This groove is not necessary for the workability of this claim and is provided as an additional means of support for other types of end feet. There is also a third groove 9 running along the base 10 of the body.

The foot member 2 has two projections 11 with entrant lips 12, located adjacent the top of the feet members. A further projection 13, with a re-entrant lip 14, is located adjacent the base of the foot member. The two projections 11 fit into the channels 15 with the lips 12 locking behind the shoulder 16 in the contact recess (see FIGS. 2 and 3). The projection 13 extends along the groove 9 with the lip extending into the second contact recess 3' (see FIG. 4).

Two further projections 17 maybe located on the foot 2 to fit into the lateral grooves 7 of the body portion 1, (as shown in FIG. 2). Thus the feet members are securely attached to the body member. Because of the type of attachment the tolerances for manufacture of the feet and the body are not as critical as those of the prior art connectors.

Figure 4:
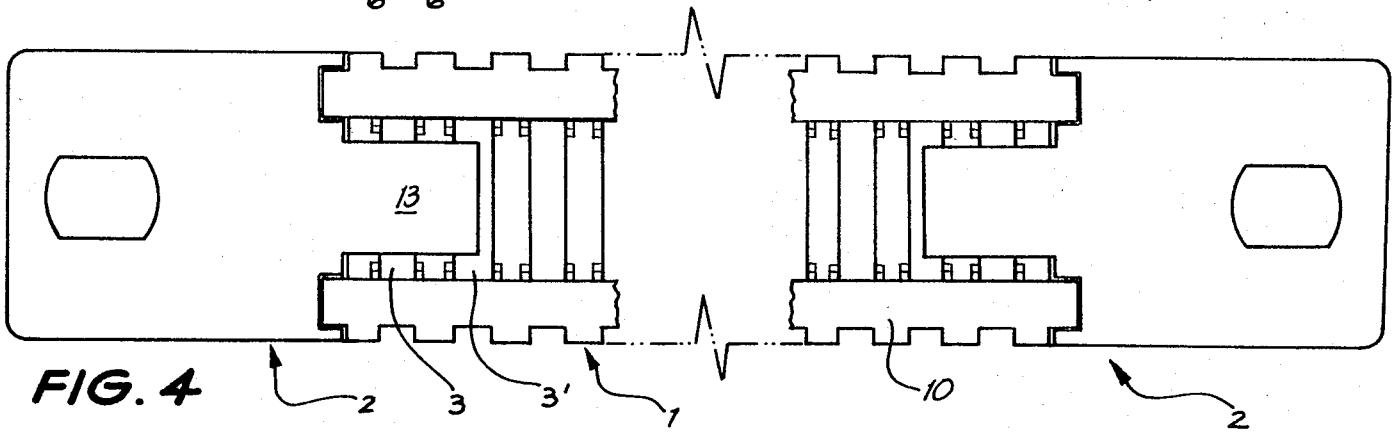

The projections 11 and 13 are so shaped that they extend across the contact recesses 3 without interfering with the contacts fitted into the contact recesses (see FIGS. 3 and 4).

The three types of projections rigidly affix the foot member to the body ameliorating any lateral or transverse movement between the foot member and the body.

If the body of the contact is to be shortened the feet members are removed and the contacts can be removed and the body shortened and the feet members reattached without any damage to the remaining contacts.

It is therefore apparent from the above that the present invention provides an improved and novel connectors with advantages over existing connectors.

It should be obvious to people skilled in the art that the described connector can be altered without departing from the spirit or the sense of the invention, by having the projections locking into recesses other than those shown in the drawings; or by changing the means of attaching the feet to the board or the style of feet.

The claims defining the invention are as follows:

1. Electrical connector comprising:

a supportive body;

a row of contact cavities arranged in said supportive body to receive contact elements;

retaining means associated with said cavities for retaining contact elements in said row;

feet means having upper and lower projections with inwardly directed re-entrant lips, the projections extending in a common direction, so as to lock the feet means securely onto the supportive body without interfering with the contact elements in said rows; and upper and lower channels defined in said body to house the upper and lower projections therein.

2. An electrical connector according to claim 1, wherein said retaining means comprises shoulders over which said contact means clip.

3. An electrical connector according to claim 1, wherein said retaining means comprises holes associated with said cavities into which said contact elements are clipped, said holes being extended normally from the cavities.

4. The electrical connector of claim 1 wherein said feet means include two spaced apart, symmetrically positioned upper projections and a single, centrally located lower projection, said lower projection being at the bottom of the feet means.

5. The electrical connector of claim 4 wherein said two upper projections are at the top of the feet means.

6. An electrical connector comprising:

an elongate body section having first and second ends and including means for mounting electrical contacts thereto;

first and second mounting feet having spaced apart, symmetrically positioned first and second upper clips and a lower clip, the clips projecting in a common direction therefrom, said upper and lower clips including inwardly extending lips; and said body section including complementary recess means at said first and second ends for mating engagement with the upper and lower clip lips thereby permitting said body section to be mounted to and between said mounting feet, a plurality of said complementary recess means being formed along said body section so that various lengths of said body sections can be mounted to and between said mounting feet.

7. The electrical connector of claim 6 wherein said mounting feet include lateral guide projections and said elongate body section includes lateral depressions sized and located for mating engagement with said guide projections to aid locking said feet to said body section.

8. The electrical connector of claim 6 wherein said upper clips are at the top of the mounting feet.

* * * * *